US011397392B2

(12) United States Patent
Iwasaki

(10) Patent No.: US 11,397,392 B2
(45) Date of Patent: Jul. 26, 2022

(54) IMAGE FORMING APPARATUS WITH DOWNSTREAM END OF FIRST FEEDING SURFACE POSITIONED ABOVE UPSTREAM END OF SECOND FEEDING SURFACE

(71) Applicant: CANON KABUSHIKI KAISHA, Tokyo (JP)

(72) Inventor: Hisanori Iwasaki, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/227,467

(22) Filed: Apr. 12, 2021

(65) Prior Publication Data

US 2021/0364955 A1 Nov. 25, 2021

(30) Foreign Application Priority Data

May 19, 2020 (JP) ..... JP2020-087088

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
See application file for complete search history.

(56) References Cited

U.S. PATENT DOCUMENTS 6,794,633 B2 9/2004 Iwasaki
8,335,448 B2 12/2012 Nakajima
8,634,751 B2 1/2014 Moteki et al.
9,969,579 B2 5/2018 Yamabe et al.
10,183,828 B2 1/2019 Iwasaki
2010/0196036 A1 8/2010 Nakajima
2012/0087687 A1 4/2012 Moteki et al.
2013/0106045 A1* 5/2013 Okutsu ..... B65H 3/48 271/31
2013/0164065 A1* 6/2013 Kosuga ..... G03G 15/657 399/400
2019/0025749 A1 1/2019 Iwasaki et al.

FOREIGN PATENT DOCUMENTS

JP 2010-198011 A 9/2010
JP 2012-083415 A 4/2012
JP 2012-083416 A 4/2012
JP 2014-044232 A 3/2014

OTHER PUBLICATIONS

Oct. 7, 2021 European Search Report in European Patent Appln. No. 21168826.2.

* cited by examiner

*Primary Examiner* — Victor Verbitsky
(74) *Attorney, Agent, or Firm* — Venable LLP

(57) ABSTRACT

An image forming apparatus includes an image bearing member, a transfer portion, a fixing portion, a first sheet feeding portion including a first belt portion for forming a first feeding surface, a second sheet feeding portion including a second belt portion for forming a second feeding surface, a height detecting portion for outputting a signal depending on a height of a sheet from the first feeding surface at a detecting position, and a controller for receiving the signal outputted from the height detecting portion and for controlling the fixing portion.

11 Claims, 6 Drawing Sheets

IMAGE FORMING APPARATUS WITH DOWNSTREAM END OF FIRST FEEDING SURFACE POSITIONED ABOVE UPSTREAM END OF SECOND FEEDING SURFACE

FIELD OF THE INVENTION AND RELATED ART

The present invention relates to an image forming apparatus for forming an image on a sheet.

Conventionally, an image forming apparatus of an electrophotographic type includes a transfer portion where the image is transferred onto the sheet and includes a fixing portion where the image transferred on the sheet is fixed on the sheet. Further, as disclosed in Japanese Laid-Open Patent Application (JP-A) 2012-83416, there is a constitution in which a feeding means for sucking and feeding the sheet on a belt is provided between the transfer portion and the fixing portion with respect to a sheet feeding direction.

Further, as disclosed in JP-A 2014-44232, there is a constitution in which a loop detecting means is provided between the transfer portion and the fixing portion and a sheet feeding speed by the fixing portion is controlled on the basis of a detection result of a height of the loop.

However, in recent years, in order to realize a high image quality and high productivity, devices of the transfer portion and a fixing portion are upsized, and correspondingly, a distance in which the sheet is fed by a feeding means between the transfer portion and the fixing portion becomes long. In this constitution, for example, in the case where an elongated sheet longer than the distance between the transfer portion and the fixing portion is subjected to loop control, a sheet feeding distance with respect to the sheet feeding direction between a transfer nip and a fixing nip in which the sheet is nipped becomes long, so that there is a liability that behavior such that the sheet is looped cannot be stabilized and thus the loop control cannot be carried out.

SUMMARY OF THE INVENTION

A principal object of the present invention is to provide an image forming apparatus, in which an elongated sheet is subjected to loop control between a transfer portion and a fixing portion, capable of improving a sheet feeding performance.

According to an aspect of the present invention, there is provided an image forming apparatus comprising: an image bearing member configured to bear a toner image; transfer means including a transfer nip in which a sheet is nipped and fed and configured to transfer the toner image from the image bearing member onto the sheet nipped in the transfer nip; fixing means including a fixing nip in which the sheet is nipped and fed and configured to fix the toner image, on the sheet, transferred by the transfer means; first feeding means including a first endless belt having air permeability and including a first belt portion for forming a first feeding surface on which the sheet is fed, a first stretching member for rotatably stretching the first belt portion, and a first air sucking portion capable of attracting the sheet to the first feeding surface by sucking air through the first belt portion, and configured to feed the sheet from the transfer means toward the fixing means by rotating the first belt portion; second feeding means including a second endless belt having air permeability and including a second belt portion for forming a second feeding surface on which the sheet is fed, a second stretching member for rotatably stretching the second belt portion, and a second air sucking portion capable of attracting the sheet to the second feeding surface by sucking air through the second belt portion, wherein the second feeding means is provided downstream of the first feeding means with respect to a sheet feeding direction and is configured to feed the sheet, fed by the first feeding means, toward the fixing means by rotating the first belt portion; a height detecting means configured to output a signal depending on a height of the sheet from the first feeding surface at a detecting position where the height detecting means overlaps with the first feeding means as viewed in a widthwise direction of the sheet perpendicular to the sheet feeding direction and which is downstream of a center of the first feeding means with respect to the sheet feeding direction; and a controller configured to receive the signal outputted from the height detecting means and configured to control the fixing means.

Further features of the present invention will become apparent from the following description of exemplary embodiments with reference to the attached drawings.

DESCRIPTION OF THE EMBODIMENTS

In the following, an embodiment for carrying out the present invention will be described by making reference to the drawings.

Figure 1:
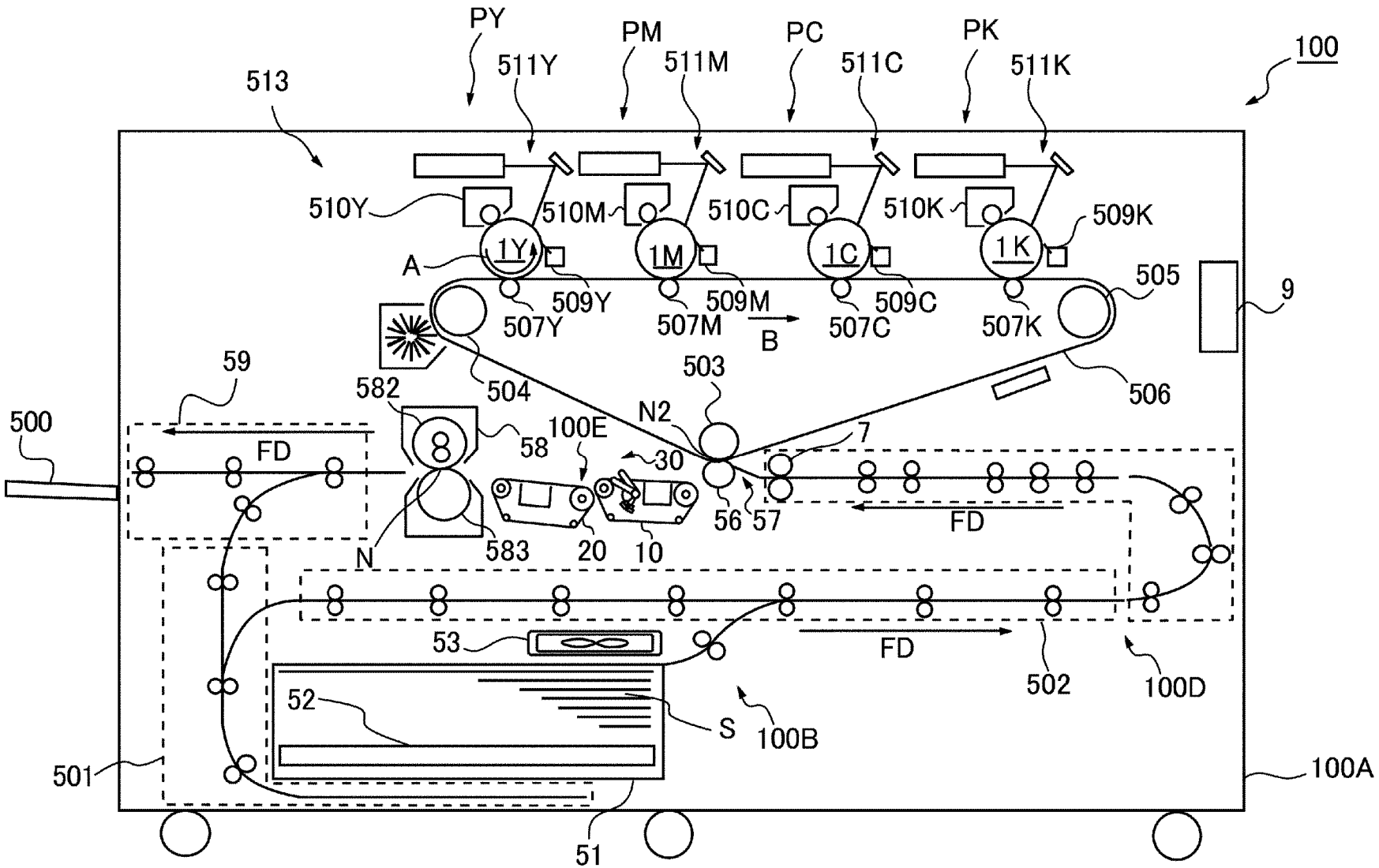
FIG. 1 is a schematic structural view of an image forming apparatus of an embodiment 1 of the present invention.

FIG. 1 is a schematic structural view of an image forming apparatus 100 of an embodiment 1. First, with reference to FIG. 1, a structure of the image forming apparatus 100 will be described. The image forming apparatus 100 includes a feeding portion 100B for feeding a sheet and a height feeding (conveying) portion 100*d* for feeding (conveying) the sheet fed by the feeding portion 100B. Further, the image forming apparatus 100 includes an image forming portion 513 for forming a toner image on the sheet, a secondary transfer portion 57 where the toner image is transferred onto the sheet, and a belt feeding unit 100E for feeding the sheet, on which the toner image is transferred, to a fixing portion 58. Further, the image forming apparatus 100 includes a post-feeding portion 59 for feeding the sheet on which the toner image is fixed by the fixing portion 58. The feeding portion 100B includes a sheet cassette 51 in which sheets are stacked on a life-up device 52 and includes a sheet feeding means 53 for sending (feeding) a sheet S stacked in the sheet cassette 51. As a sheet feeding method by the sheet feeding means 53, for example, a friction-separation type by a roller and a separation attraction type by the air exist, but in FIG. 1, an example using the separation attraction type by the air is shown. Incidentally, in the image forming apparatus 100, a constitution in which the sheet is fed by the friction-separation type by the roller may also be employed. The sheet fed from the feeding portion 100B is successively delivered by pluralities of roller pairs provided in the sheet feeding portion 100D and then is fed toward the secondary transfer portion 57.

The image forming portion 513 is an image forming means of a so-called tandem type in which image forming stations PY, PM, PC and PK of an electrophotographic type for forming toner images of Y (yellow), M (magenta), C (cyan) and K (black), respectively, are arranged in line (series). The image forming stations PY, PM, PC and PK have a common constitution except that toner colors are different from each other. For that reason, in this embodiment, a constitution of the image forming station PY will be described as an example, and constitutions of the image forming stations PM, PC and PK will be omitted from description. Incidentally, in FIG. 1, constituent elements of the image forming stations PY, PM, PC and PK are represented by adding suffices "Y", "M", "C" and "K", respectively. The image forming station PY includes a photosensitive drum 1Y, an exposure device 511Y, a developing device 510Y, a primary transfer device 507Y and a cleaner 509Y. The image forming portion 513 includes an intermediary transfer belt 506 as an example of an image bearing member on which toner images formed (visualized) by the image forming stations PY, PM, PC and PK are borne. The intermediary transfer belt 506 is supported in a state in which the intermediary transfer belt 506 is stretched by a driving roller 505, a tension roller 504 and an inner transfer roller 503 and is rotated in an arrow B direction by drive of the driving roller 505.

A secondary transfer roller 56 press-contacts the intermediary transfer belt 506 supported by the inner transfer roller 503 from an inside of the intermediary transfer belt 506 and forms a secondary transfer nip N2 between itself and the intermediary transfer belt 506. The secondary transfer portion 57 as a transfer means in this embodiment is constituted by the secondary transfer roller 56, the intermediary transfer belt 506 and the inner transfer roller 503. Transfer residual toner and paper dust and the like which remain on a surface of the intermediary transfer belt 506 after passing through the secondary transfer nip N2 are removed by a cleaning device. The fixing portion 58 provided on a side downstream of the secondary transfer portion 57 with respect to a sheet feeding direction FD is a fixing means for fixing the toner image on the sheet by heat and pressure. The fixing portion 58 includes a heating roller 582 including a heater therein and an opposite roller 583 which is provided contactable to the heating roller 582 and which forms a fixing nip N in cooperation with the heating roller 582. Further, the fixing portion includes a heating roller temperature sensor for detecting a surface temperature of the heating roller 582 and a pressing roller temperature sensor for detecting a surface temperature of the opposite roller 583. The heating roller temperature sensor and the pressing roller temperature sensor are provided so as to maintain the surface temperatures of the heating roller 582 and the opposite roller 582, respectively, at appropriate temperatures.

With respect to the sheet feeding direction FD, between the secondary transfer portion 57 and the fixing portion 58, the belt feeding unit 100E is provided. The belt feeding unit 100E is constituted by a first belt feeding portion 10 provided on an upstream side with respect to the sheet feeding direction FD and a second belt feeding portion 20 provided on a side downstream of the first belt feeding portion 10 with respect to the sheet feeding direction FD. A constitution of the belt feeding unit 100E will be described later.

The post-feeding portion 59 discharges the sheet, discharged from the fixing portion 58, to an outside of an apparatus main assembly 100A of the image forming apparatus 100. The post-feeding portion 59 includes a reverse feeding portion 501 for reversely feeding the sheet and a double-side feeding passage 502 where the sheet reversed by the reverse feeding portion 501 is fed and which is merged with a sheet feeding passage of the sheet feeding portion 100D.

Next, a series of a flow of formation of the image on the sheet in the image forming apparatus 100 will be described. On the basis of an image forming job inputted to the image forming apparatus 100, first, the photosensitive drum 1Y is exposed to light by the exposure device 511Y, so that an electrostatic latent image is formed on a surface of the photosensitive drum 1Y. The electrostatic latent image is developed by the developing device 510Y and thus is visualized as a toner image. The toner image carried on the surface of the photosensitive drum 1Y is primary-transferred onto the intermediary transfer belt 506. Similarly, the toner images carried on the surfaces of other photosensitive drums are successively primary-transferred superposedly onto the intermediary transfer belt 506 by the primary transfer device 507Y. The toner images primary-transferred on the intermediary transfer belt 506 are secondary-transferred onto the sheet S, fed from the feeding portion 100B, in the secondary transfer nip N2 as a transfer nip in this embodiment. Incidentally, the intermediary transfer belt 506 is rotationally driven by the driving roller 505 rotating at a certain speed and thus is rotated in a state in which a peripheral speed thereof is kept so as to be a certain transfer speed. Accordingly, a feeding speed of the sheet in the secondary transfer nip N2 is the peripheral speed of the intermediary transfer belt 506. Hereinafter, the feeding speed of the sheet in the secondary transfer portion 57 is referred to as a "transfer speed (velocity) VT". The transfer speed VT is the sheet feeding speed when the toner image is transferred at the secondary transfer portion 57.

A registration roller pair 7 of the sheet feeding portion 100D receives the sheet S in a state in which rotation thereof is stopped, and then, the rotation is started by being timed to the toner images on the intermediary transfer belt 506, so that the sheet S is sent toward the secondary transfer nip N2. In the secondary transfer nip N2, the toner images are transferred onto the sheet S. The sheet S on which the toner images are transferred is fed from the secondary transfer nip N2 toward the fixing portion 58 by the belt feeding unit 100E. In the fixing portion 58, the sheet S is nipped in the fixing nip N and the (unfixed) toner images are fixed on the sheet S under application of heat and pressure. The sheet S sent from the fixing portion 58 is discharged by the post-feeding portion 59.

In the case where images are formed on both surfaces (front surface and back surface) of the sheet, the sheet sent from the fixing portion 58 is fed to the reverse feeding portion 501, and is fed toward the double-side feeding passage 502 after being reversed by the reverse feeding portion 501. The sheet is fed to the feeding path of the sheet feeding portion 100D via the double-side feeding passage 502. Then, similarly as in the case of a first surface (front surface), the toner image is formed on a second surface (back surface).

Figure 2:
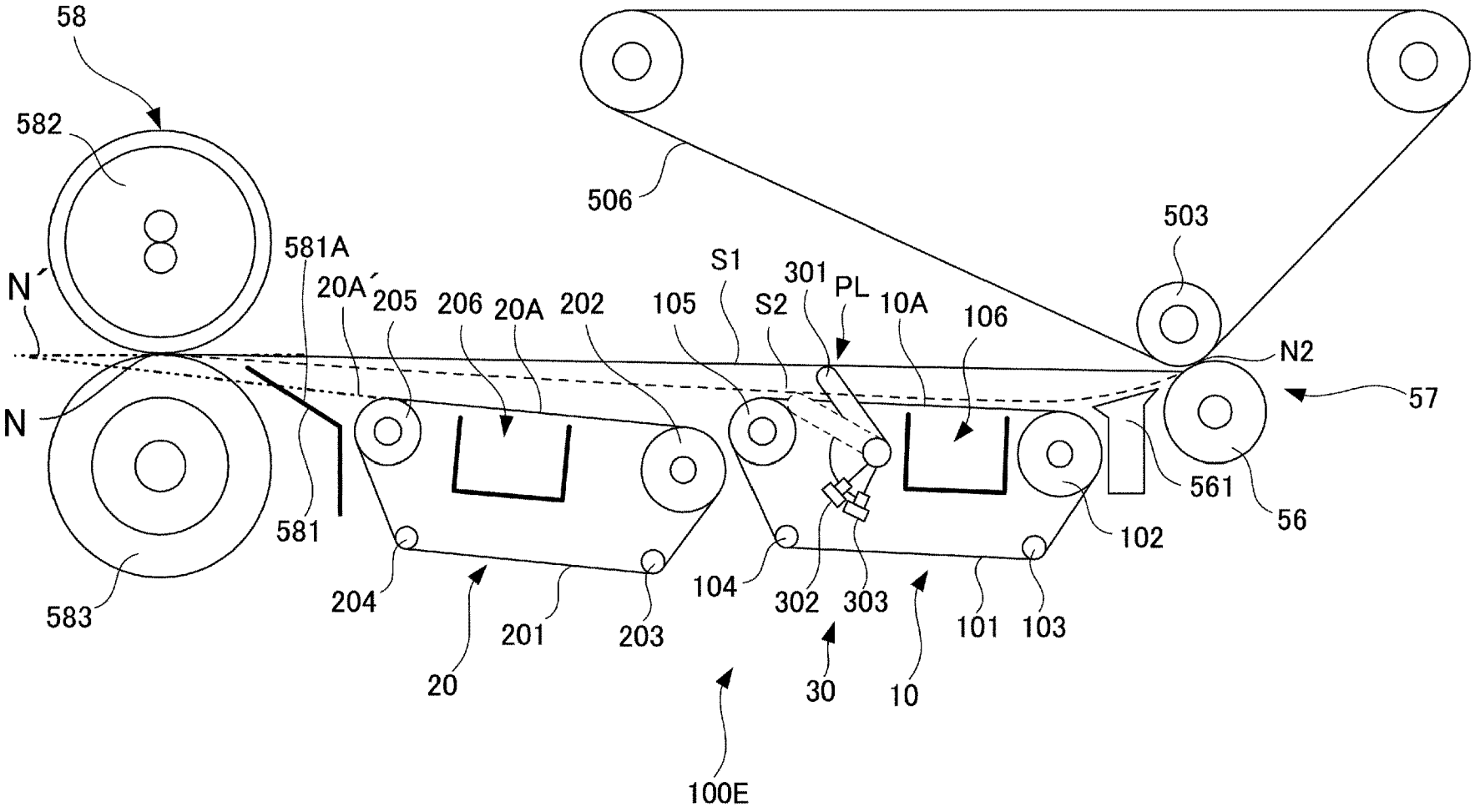
FIG. 2 is a sectional view showing a secondary transfer portion, a belt feeding unit and a fixing potion in the embodiment 1.

Next, a detailed constitution of the belt feeding unit 100E and a peripheral portion thereof in this embodiment will be described. FIG. 2 is a sectional view showing the secondary transfer portion 57, the belt feeding unit 100E and the fixing portion 58. The belt feeding unit 100E includes the first belt feeding portion as a first feeding means and the second belt feeding portion 20 as a second feeding means in this embodiment. With respect to the sheet feeding direction FD, the first belt feeding portion 10 is disposed downstream of the secondary transfer nip N2 and the second belt feeding portion 20 is disposed downstream of the first belt feeding portion 10 and upstream of the fixing nip N.

With respect to the sheet feeding direction FD, between the belt feeding unit 100E and the secondary transfer nip N2, a transfer separation guide 561 for separating the sheet fed from the secondary transfer nip N2 and for guiding the sheet toward the belt feeding unit 100E is provided. Further, with respect to the sheet feeding direction FD, between the belt feeding unit 100E and the fixing nip N, a pre-fixing guide 581 for guiding, toward the fixing nip N, the sheet fed by the belt feeding unit 100E is provided. As shown in FIG. 2, when the first belt feeding portion 10 is viewed in a widthwise direction of the sheet perpendicular to the sheet feeding direction FD, the first belt feeding portion 10 is capable of being disposed at a position lower than the fixing nip N. When the second belt feeding portion 20 is viewed in the widthwise direction of the sheet perpendicular to the sheet feeding direction FD, the second belt feeding portion 20 is capable of being disposed at a position lower than the fixing nip N. By such a constitution, a leading end of the sheet passed through the secondary transfer nip N is fed toward the first belt feeding portion 10 along the transfer separation guide 561. Further, as viewed in the widthwise direction of the sheet perpendicular to the sheet feeding direction FD, a downstream end of a feeding surface 10A of the first belt feeding portion 10 is positioned above an upstream end of a feeding surface 20A of the second belt feeding portion 20. By such an arrangement, bucking of the sheet, fed by the first belt feeding portion 10, by the second belt feeding portion 20 is prevented. In this embodiment, a first feeding surface is the feeding surface 10A, and a second feeding surface is the feeding surface 20A.

Further, the second belt feeding portion 20 feeds the sheet toward the fixing portion 58 along the feeding surface 20A. A phantom line 200A' extended from the feeding surface 2A toward a downstream side of the sheet feeding direction FD crosses a nip line N' of the fixing nip N on a side downstream of the fixing nip N with respect to the sheet feeding direction FD. The nip line N' of the fixing nip N refers to a tangential line, of tangential lines of the fixing nip N, contacting the heating roller 582 and the opposite roller 583. By such a constitution, the sheet fed by the second belt feeding portion 20 is fed in a crossing direction extending from below toward above in FIG. 2. Further, with respect to the sheet feeding direction FD, between the second belt feeding portion 20 and the fixing portion 58, the pre-fixing guide 581 as a guiding member in this embodiment is provided. The pre-fixing guide 581 includes a guiding surface 581A for guiding the sheet, toward the fixing nip N, a leading end of the sheet fed along the feeding surface 20A. As viewed in the widthwise direction of the sheet perpendicular to the sheet feeding direction FD, the guiding surface 581A of the pre-fixing guide 581 is positioned downstream of the second belt feeding portion 20 and crosses the phantom line 20A' of the feeding surface 20A. By such a constitution, the sheet fed by the second belt feeding portion 20 is guided to the fixing nip N by the pre-fixing guide 581 in a state in which the pre-fixing guide 581 crosses the nip line N' from below toward above in FIG. 2.

Incidentally, of the tangential lines of the fixing nip N, the nip line N' exists on a flat surface formed by the tangential line contacting the heating roller 582 and the opposite roller 583. That is, the sheet is fed to the fixing nip N in the state in which the pre-fixing guide 581 crosses the nip line N' from below toward above in FIG. 2, and therefore, it is possible to suppress contact of the heating roller 582 to the unfixed toner on the sheet.

The first belt feeding portion 10 includes a first feeding belt 101 as a first belt portion, a first driving roller 102 rotatably stretching the first feeding belt 101, and follower rollers 103, 104 and 105 in this embodiment. A first stretching member in this embodiment is constituted by the first driving roller 102 and the follower rollers 103, 104 and 105. Further, the first belt feeding portion 10 includes a motor for rotating the first feeding belt 101 by rotating the first driving roller 102. The first feeding belt 101 is a member which includes endless belts (belts 101*a*, 101*b*, 101*c*, 101*d* (FIG. 3) each provided with many holes and which has air permeability such that air is capable of passing through the first feeding belt 101 between inner and outer peripheral surfaces of the first feeding belt 101 via the holes. Further, inside the inner peripheral surface of the first feeding belt 101, a first suction fan 106 for attracting the sheet to the outer peripheral surface of the first feeding belt 101 is provided.

Figure 4:
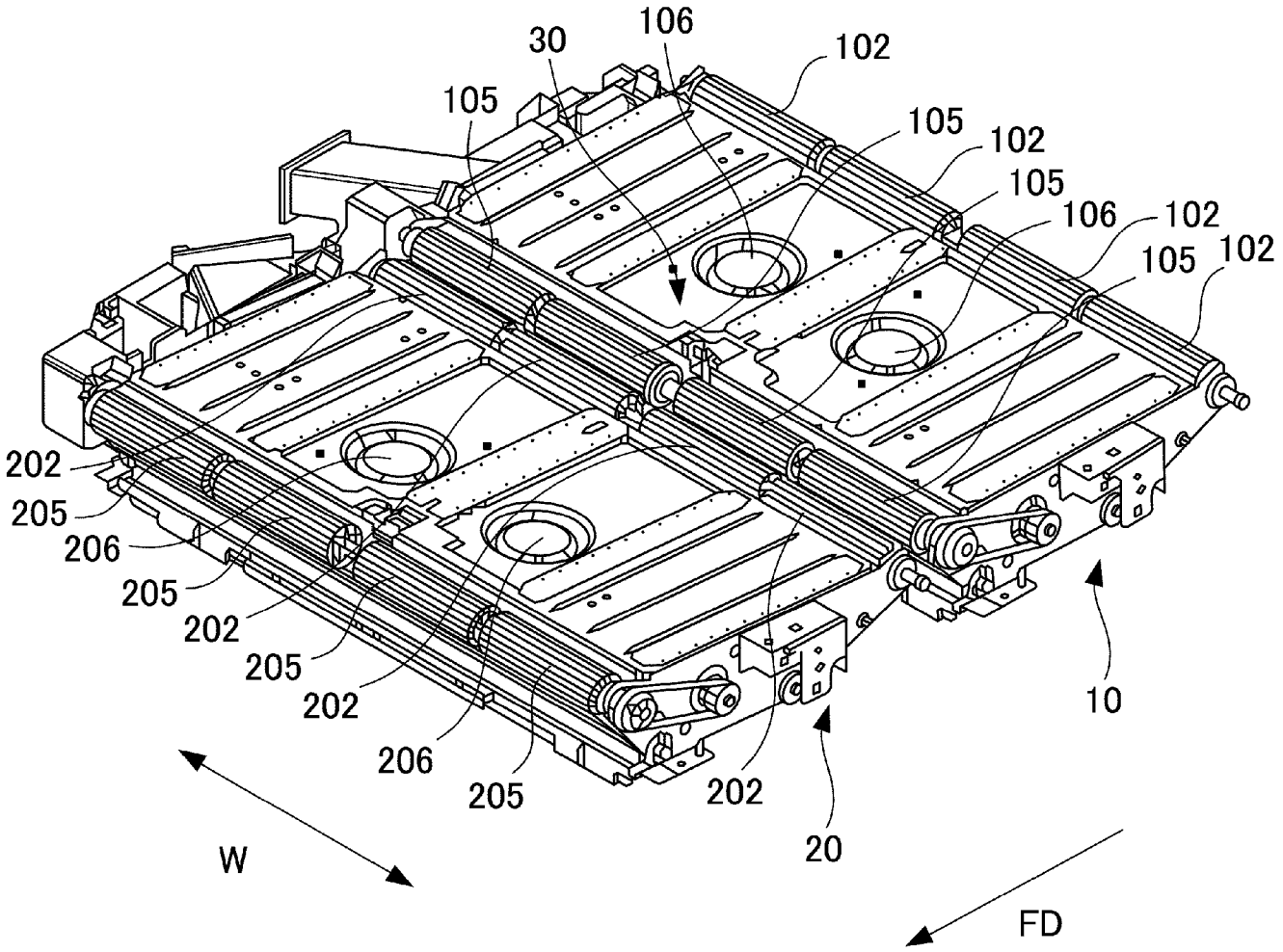
FIG. 4 is a perspective view of the belt feeding unit in a state in which a belt is dismounted in the embodiment 1.

FIG. 4 is a perspective view of the belt feeding unit 100E in a state in which the first feeding belt 101 and the second feeding belt 201 are dismounted. As shown in FIG. 4, the first belt feeding portion 10 is provided with the first suction fan 106 for sucking the air through air bent holes. The first suction fan 106 sucks the air from the outer peripheral surface toward the inner peripheral surface of the first feeding belt 101 through many holes formed in the first feeding belt 101. The first suction fan 106 is provided with the air bent holes which open from the inside of the first feeding belt 101 toward the feeding surface 10A (FIG. 2) and is capable of attracting the sheet, fed by the first feeding belt 101, to the feeding surface 10A by sucking the air through the air bent holes. That is, a first air sucking portion in this embodiment is the first suction fan 106 capable of attracting the sheet to the feeding surface 10A.

As shown in FIG. 2, as viewed in the widthwise direction of the sheet perpendicular to the sheet feeding direction FD, the sheet passed through the secondary transfer nip N2 is fed to an upper surface of the first feeding belt 101. That is, the sheet is fed to the feeding surface 10A formed by the first feeding belt 101 after passed through the secondary transfer nip N2. As a result, the sheet is fed in a state in which the sheet is attracted to the feeding surface 10A by the influence of air suction by the first suction fan 106. Further, in this embodiment, the first driving roller 102 is rotated so that a feeding speed V1 of the sheet by the first feeding belt 101 becomes slightly higher than the transfer speed VT. By doing so, buckling of the sheet can be prevented by a speed difference between the secondary transfer nip N2 and the first feeding belt 101. Incidentally, the feeding speed V1 of the sheet by the first feeding belt 101 is a peripheral speed of the first feeding belt 101.

The second belt feeding portion 20 includes a second feeding belt 201 as a second belt portion, a second driving roller 202 rotatably stretching the second feeding belt 201, and follower rollers 203, 204 and 205 in this embodiment. A second stretching member in this embodiment is constituted by the second driving roller 202 and the follower rollers 203, 204 and 205. Further, the second belt feeding portion 20 includes a motor for rotating the second feeding belt 201 by rotating the second driving roller 202. The second feeding belt 201 is a member which includes endless belts (belts 201*a*, 201*b*, 201*c*, 201*d* (FIG. 3) each provided with many holes and which has air permeability such that air is capable of passing through the second feeding belt 201 between inner and outer peripheral surfaces of the second feeding belt 201 via the holes. Further, inside the inner peripheral surface of the second feeding belt 201, a second suction fan 206 for attracting the sheet to the outer peripheral surface of the second feeding belt 201 is provided.

As shown in FIG. 4, the second belt feeding portion 20 is provided with the second suction fan 206 for sucking the air through air bent holes. Further, as shown in FIGS. 2 and 4, with respect to the sheet feeding direction FD, a position of a center of the second suction fan 206 may also be downstream of a center of the second feeding belt 201. By doing so, in a state in which the sheet is attracted to the feeding surface 20A, the sheet can be fed to the fixing nip N. The second suction fan 206 is provided with the air bent holes which open from the inside of the second feeding belt 201 toward the feeding surface 20A (FIG. 2) and is capable of attracting the sheet, fed by the second feeding belt 201, to the feeding surface 20A by sucking the air through the air bent holes. That is, a second air sucking portion in this embodiment is the second suction fan 206 capable of attracting the sheet to the feeding surface 20A.

Further, a suction force of the air by the second suction fan 206 can be switched between a suction force for attracting the sheet toward the feeding surface 20A and a suction force smaller than this suction force. The suction force of the air by the second suction fan 206 capable of attracting the sheet toward the feeding surface 20A is a first suction force in this embodiment. The suction force smaller than the suction force for attracting the sheet toward the feeding surface 20A refers to, for example, a suction force of a degree such that the sheet attracted to the feeding surface 20A is capable of freely moving on the feeding surface 20A. The air suction force, by the second suction fan 206, smaller than the suction force capable of attracting the sheet to the feeding surface 20A is a second suction force in this embodiment. In this embodiment, control may also be carried out so that the air suction force by the first suction fan 106 and the air suction force by the second suction fan 206 are the same suction force.

As shown in FIG. 2, as viewed in the widthwise direction of the sheet perpendicular to the sheet feeding direction FD, the sheet passed through the first feeding belt 101 is fed to an upper surface of the second feeding belt 201. That is, the sheet is fed to the feeding surface 20A formed by the second feeding belt 201 after having passed through the feeding surface 10A. As a result, the sheet is fed in a state in which the sheet is attracted to the feeding surface 20A by drive of the second suction fan 206. Further, in this embodiment, the second driving roller 202 is rotated so that a feeding speed V2 of the sheet by the second feeding belt 201 becomes slightly higher than the feeding speed V1 of the sheet by the first feeding belt 101. By doing so, buckling of the sheet can be prevented by a speed difference between the first feeding belt 101 and the second feeding belt 201. Incidentally, the feeding speed V2 of the sheet by the second feeding belt 201 is a peripheral speed of the second feeding belt 201.

Further, in this embodiment, a height detecting means 30 for detecting a height of the sheet from the feeding surface 10A in a detecting position PL positioned on a state downstream of the first suction fan 106 of the first belt feeding portion 10 with respect to the sheet feeding direction FD is provided. Incidentally, the detecting position PL of the height detecting means 30 in this embodiment is a position, where formation of looseness (loop) of the sheet is most visible, for example, is positioned on a side slightly downstream of the first suction fan 106 with respect to the sheet feeding direction FD. However, as regards the detecting position PL of the height detecting means 30, the detecting position PL may also be any position between the secondary transfer nip N2 and the fixing nip N with respect to the sheet feeding direction FD. Further, in this embodiment, the detecting position of the height detecting means 30 overlaps with the belt feeding unit 100E with respect to the sheet feeding direction FD as viewed in the widthwise direction of the sheet perpendicular to the sheet feeding direction FD. By doing so, with respect to the sheet feeding direction FD, a height of the sheet from the feeding surface 10A can be detected with reliability.

Figure 3:
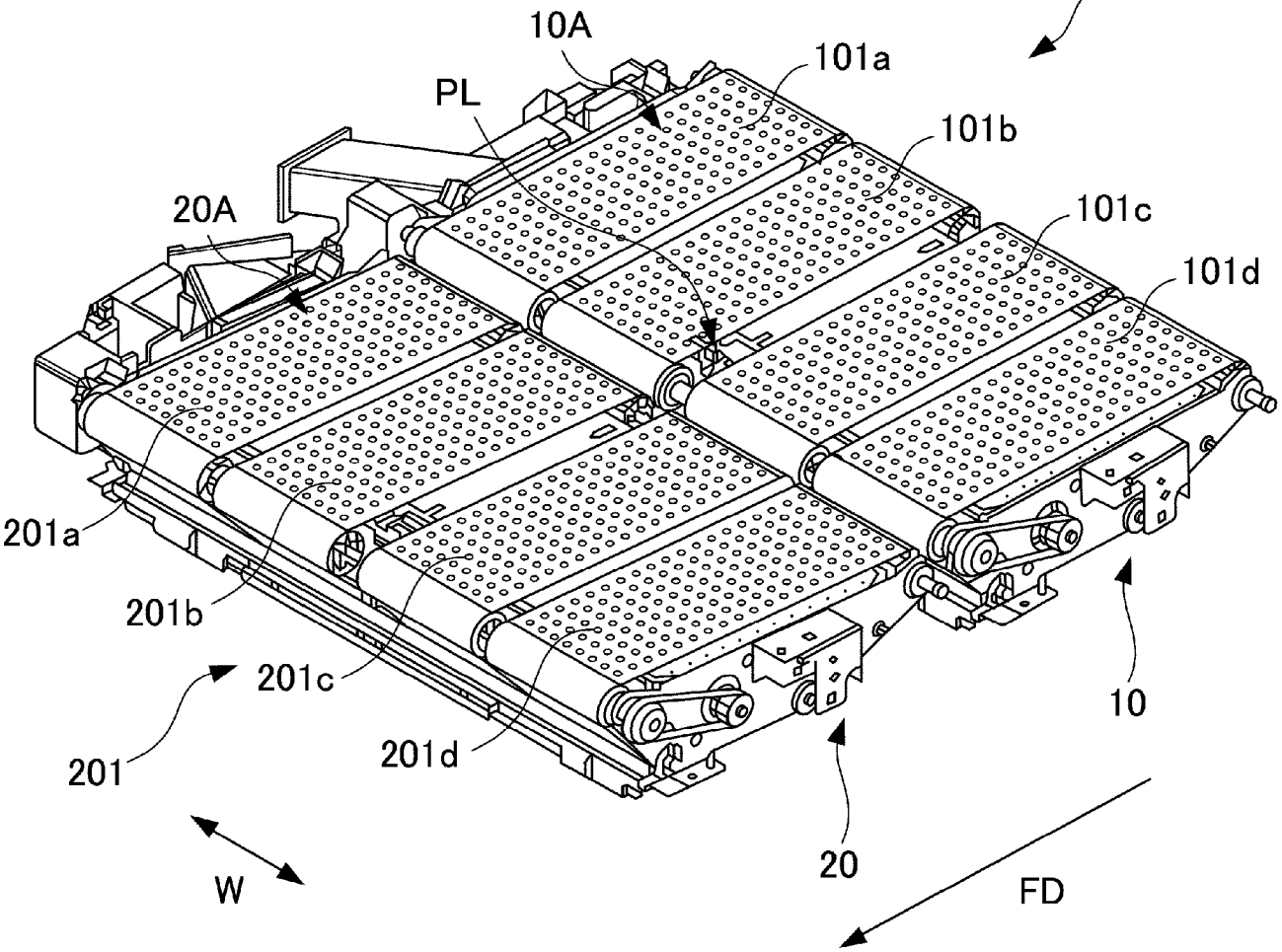
FIG. 3 is a perspective view of the belt feeding unit in the embodiment 1.

FIG. 3 is a perspective view of the belt feeding unit 100E. As shown in FIG. 3, the first feeding belt 101 includes belts 101*a*, 101*b*, 101*c* and 101*d*. Each of the belts 101*a*, 101*b*, 101*c* and 101*d* is an endless belt in which numbers of holes are formed and constitutes the feeding surface 10A of the first feeding belt 101 on which the sheet is fed. As shown in FIG. 3, the belts 101*a*, 101*b*, 101*c* and 101*d* are disposed with intervals therebetween with respect to the widthwise direction W perpendicular to the sheet feeding direction FD, and the detecting position PL of the height detecting means 30 is disposed between the belt 101*b* and the belt 101*c*. That is, in this embodiment, a first endless belt is the belt 101*b* and a second endless belt is the belt 101*c*, and the detecting position PL of the height detecting means 30 is disposed between the belts 101*b* and 101*c* with respect to the widthwise direction W. Incidentally, a locating position of the detecting position PL of the height detecting means 30 may also be between adjacent belts (for example, the belt 101*a* and the belt 101*b*) with respect to the widthwise direction W, in addition to the locating position shown in FIG. 3. Further, a center of the sheet with respect to the widthwise direction W on the first feeding belt 101 may also be disposed between the belts 101*b* and 101*c*. By such an arrangement, in the case where feeding of the sheet in the image forming apparatus 100 is made on a center(-line) basis with respect to the widthwise direction W, with respect to the widthwise direction W, it becomes possible to reliably detect the height of the sheet from the feeding surface 10A.

As shown in FIG. 3, the second feeding belt 201 includes, as examples of a second endless belt in this embodiment, belts 201*a*, 201*b*, 201*c* and 201*d*. Each of the belts 201*a*, 201*b*, 201*c* and 201*d* is an endless belt in which numbers of holes are formed and constitute the feeding surface 20A of the second feeding belt 201 on which the sheet is fed. As shown in FIG. 3, the belts 201*a*, 201*b*, 201*c* and 201*d* are disposed with intervals therebetween with respect to the widthwise direction W perpendicular to the sheet feeding direction FD.

The height detecting means 30 includes a detecting flag 301 capable of being displaced depending on the height of the sheet from the feeding surface 10A as viewed in the widthwise direction W perpendicular to the sheet feeding direction FD. A position where the detecting flag 301 as a flag member in this embodiment and the sheet fed by the belt feeding unit 100E are in contact with each other is an example of the detecting position PL of the height detecting means 30. The detecting flag 301 is displaced depending on the height of the sheet from the feeding surface 10A, fed by the belt feeding unit 100E. In FIG. 2, as the height of the sheet, from the feeding surface 10A, fed by the belt feeding unit 100E, S1 and S2 lower than S1 are shown as an example in the order of height as viewed in the widthwise direction W perpendicular to the sheet feeding direction FD. A first position in this embodiment is a position of the detecting flag 301 when the sheet is detected above S1 relative to the feeding surface 10A. Further, a second position in this embodiment is a position of the detecting flag 301 when the sheet is detected between S1 and S2 relative to the feeding surface 10A, and a third position in this embodiment is a position of the detecting flag 301 when the sheet is detected below S2 relative to the feeding surface 10A. That is, in this embodiment, the detecting flag 301 is capable of being displaced to the first position, the second position and the third position in the order of height.

Further, the height detecting means 30 includes sensors 302 and 303, such as photo-interruptors which are switchable between a light-blocking state and a light-transmission state depending on the position of the detecting flag 301 and which output a signal depending on the state thereof. The sensor 302 as a first sensor in this embodiment becomes the light-transmission state when the height of the sheet from the feeding surface 10A is higher than S1, and outputs an OFF signal. On the other hand, the sensor 302 becomes the light-blocking state when the height of the sheet from the feeding surface 10A is S1 or lower (in a state in which the sheet is closer to the feeding surface 10A than S1 is), and outputs an ON signal. Further, the sensor 303 as a second sensor in this embodiment becomes the light-transmission state when the height of the sheet from the feeding surface 10A is lower than S2, and outputs an OFF signal. On the other hand, the sensor S303 becomes the light-blocking state when the height of the sheet from the feeding surface 10A is S2 or higher (in a state in which S2 is closer to the feeding surface 10A than the sheet is), and outputs an ON signal. That is, from the height detecting means 30, a signal depending on a combination of the signal outputted from the sensor 302 and the signal outputted from the sensor 303.

Figure 5:
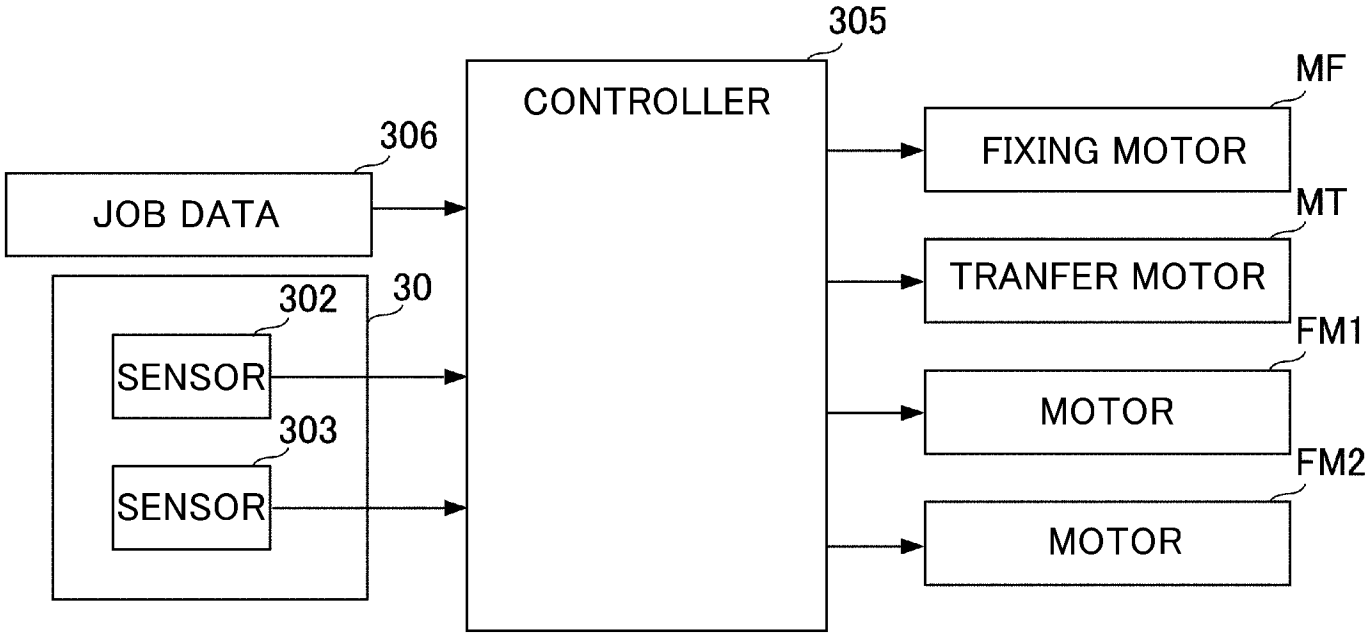
FIG. 5 is a block diagram showing a control constitution of the image forming apparatus of the embodiment 1.

In the case where the height of the sheet from the feeding surface 10A, in other words, in the case where the detecting flag 301 is positioned above S1, the signal outputted from the height detecting means 30 is a combination of the OFF signals of the sensors 302 and 303. Further, when the sensor 302 outputs the OFF signal, the detecting flag 301 is positioned above S1, and therefore, the sensor 303 becomes the light-blocking state and outputs the OFF signal. Thus, in this embodiment, when the sensor 302 outputs the OFF signal, the sensor 303 also outputs the OFF signal. A first signal in this embodiment corresponds to a signal outputted from the height detecting means 30 when a combination of the OFF signals of the sensors 302 and 303 is formed. Further, when the detecting flag 302 is positioned between S1 and S2, the signal outputted from the height detecting means 30 is a combination of the ON signal of the sensor 302 with the OFF signal of the sensor 303. That is, a second signal in this embodiment corresponds to a signal outputted from the height detecting means 30 when a combination of the ON signal of the sensor 302 and the OFF signal of the sensor 303 is formed. Further, when the detecting flag 301 is positioned below S2, the signal outputted from the height detecting means 30 is a combination of the ON signals of the sensors 302 and 303. Further, the sensor 302 is put in the light-blocking state by the detecting flag 301 when the sensor 303 outputs the ON signal, and therefore, when the sensor 303 outputs the ON signal, the sensor 302 also outputs the ON signal. That is, a third signal in this embodiment corresponds to a signal outputted from the height detecting means 30 when a combination of the ON signals of the sensors 302 and 303 is formed. The signal depending on output values of the sensors 302 and 303 is sent to a controller 305 (FIG. 5).

Incidentally, a state in which the sheet height is S1 refers to, for example, a state in which the sheet is fed at a position spaced from the feeding surface 10A before the sheet is stretched between the fixing portion 58 and the secondary transfer portion 57 with respect to the sheet feeding direction FD. Further, a state in which the sheet height is S2 refers to a state in which the sheet is fed at a position closest to the feeding surface 10A before the sheet is excessively loosened between the fixing portion 58 and the secondary transfer portion 57 with respect to the sheet feeding direction FD. That is, when the sheet is positioned between S1 and S2, the sheet is fed not only in a state in which the sheet is spaced from the feeding surface 10A but also in a state in which the sheet is loosened. Accordingly, when the combination of signals outputted from the height detecting means 30 is the ON signal of the sensor 302 and the OFF signal of the sensor 303, the detecting flag 301 is positioned between S1 and S2 as viewed in the widthwise direction W perpendicular to the sheet feeding direction FD. Further, when the combination of the signals outputted from the height detecting means 30 is the ON signal of the sensor 302 and the OFF signal of the sensor 303, the sheet is fed not only in the state in which the sheet is spaced from the feeding surface 10A but also in the state in which the sheet is loosened. In other words, when the detecting flag 301 is positioned between S1 and S2 as viewed in the widthwise direction W perpendicular to the sheet feeding direction FD, the sheet is in a spaced state from the feeding surface 10A and in a loosened state.

Incidentally, with respect to the sheet feeding direction FD, between the registration roller pair 7 and the secondary transfer nip N2, a sheet detecting sensor for detecting the sheet may also be provided. The sheet detecting sensor detects the presence or absence of the sheet at a detecting position between the registration roller pair 7 and the secondary transfer nip N2 with respect to the sheet feeding direction FD. The signal outputted from the sheet detecting sensor is sent to the controller 305 (FIG. 5) and is used for discriminating passing of the sheet.

The sheet passed through the detecting position PL is fed from the second feeding belt 201 to the fixing portion 58. In the fixing portion 58, for example, the heating roller 582 is rotationally driven by a heating roller driving motor such as a DC brush-less motor. A sheet feeding speed in the fixing nip N can be changed. Incidentally, the sheet feeding speed in the fixing nip N refers to a peripheral speed of the heating roller 582. In the following, the feeding speed in the fixing portion 58, i.e., the feeding speed of the sheet in the fixing nip N is referred to as a "fixing speed (velocity) VF". Here, the feeding speed refers to the sheet feeding speed when the toner image is fixed on the sheet in the fixing portion 58. That is, in the fixing nip N formed between the heating roller 582 and the opposite roller 583, the toner image is fixed on the sheet while the sheet is fed at the fixing speed VF.

Next, a control constitution when the sheet is fed by the belt feeding unit 100E in the image forming apparatus 100 of this embodiment will be described with reference to FIG. 5. FIG. 5 is a block diagram showing the control constitution of the image forming apparatus 100 of this embodiment. The controller 305 as a control means in this embodiment is constituted by including a processing unit containing a CPU and a memory and including an interface for establishing communication between itself and an external device, and the like. The controller 305 receives job data 306 and is capable of controlling the feeding portion 100B, the image forming portion 513, the fixing portion 58, the secondary transfer portion 57 and the like. To the controller 305, as the job data 306, information on a kind of the sheet, for example, pieces of the information such as a basis weight of the sheet, a size of the sheet, plain paper or coated paper are sent.

Incidentally, as the job data 306, one in which information on the kind of the sheet is included in information sent as an image forming job from the external device, one generated depending on an operation of an operating portion of the image forming apparatus 100, and the like data are used. Here, the coated paper is a sheet of which surface is subjected to resin coating. Further, the controller 305 receives the signal outputted from the height detecting means 30, in other words, the signals consisting of combinations of the ON signal and the OFF signals of each of the sensors 302 and 303. The controller 305 controls, on the basis of the received signal, operations of a fixing motor MF, a transfer motor MT, a motor FM1 for driving the first suction fan 106, a motor FM2 for driving the second suction fan 206, a driving motor for driving the heating roller, and the like motor. The controller 305 is capable of adjusting the fixing speed VF by controlling drive of the fixing motor MF. Further, the controller 305 is capable of adjusting the transfer speed VT by controlling drive of the transfer motor MT.

Figure 6:
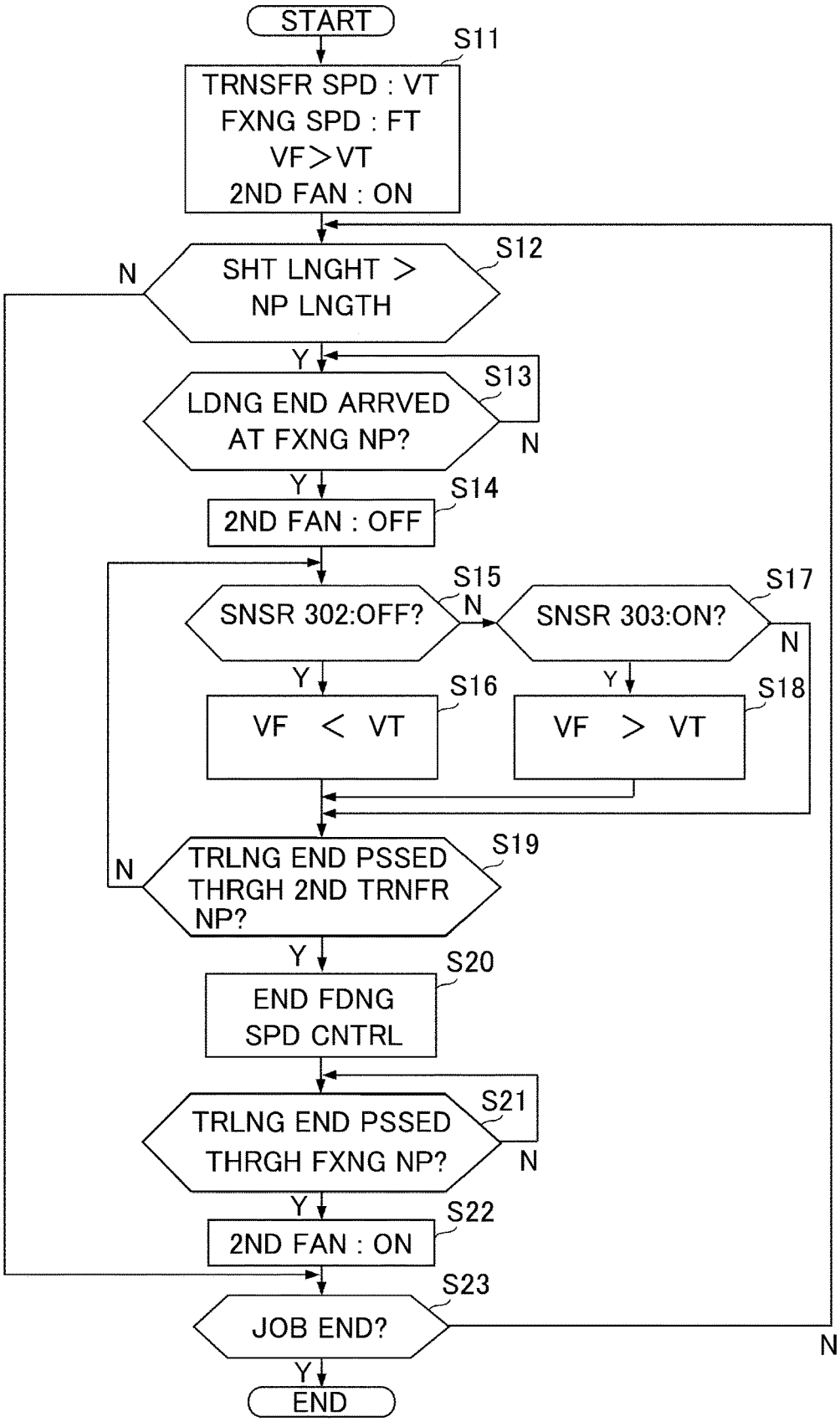
FIG. 6 is a flowchart showing a flow of an operation for feeding a sheet by the belt feeding unit in the embodiment 1.

Next, a flow of control of the belt feeding unit 100E in the image forming apparatus 100 of this embodiment will be described with reference to FIG. 6. FIG. 6 is a flowchart showing a flow of an operation for feeding the sheet by the belt feeding unit 100E in this embodiment. The flow is started by inputting information, such as the size, the basis weight and the like, on the sheet in the image forming job from the operating portion of the image forming apparatus 100 or by inputting the image forming job from the external device to the image forming apparatus 100. Further, the flag is executed principally by the controller 305. When the image forming job is started, the controller 305 executes control at the time of the start of the job (S11). In the control at the time of the start of the job in this embodiment, the controller 305 sets the transfer speed VT, a sheet feeding speed V1 at the first belt feeding portion 10, a sheet feeding speed V2 at the second belt feeding portion 20, and the fixing speed VF so as to satisfy V2>V1>VT and VF>VT. Further, the controller 305 starts feeding of the sheet under a condition of V2>V1>VT and VF>VT. Further, the controller 305 puts the second suction fan 206 in an ON state in the control at the time of the start of the image forming job. Incidentally, together with the second suction fan 206, the first suction fan 106 may also be put in an ON state.

Subsequently, the controller 305 acquires information on a length of the sheet with respect to the sheet feeding direction FD from information included in the image forming job, and discriminates whether or not the length of the sheet with respect to the sheet feeding direction FD is longer than a length between the secondary transfer nip N2 and the fixing nip N (S12). In the case where the length of the sheet with respect to the sheet feeding direction FD is shorter than the length between the secondary transfer nip N2 and the fixing nip N (S12: N), the sequence goes to S23. Then, when the image forming job is not ended (S23: N), the sequence returns to S02, and when the image forming job is ended (S23: Y), the flow is ended.

Further, when the length of the sheet with respect to the sheet feeding direction FD is longer than the length between the secondary transfer nip N2 and the fixing nip N with respect to the sheet feeding direction FD (S12: Y), the belt feeding unit 100E awaits until a leading end of the sheet reaches the fixing nip N (S13). As regards discrimination as to whether or not the leading end of the sheet reaches the fixing nip N, first, after the feeding of the sheet is started, the belt feeding unit 100E awaits until the leading end of the sheet is detected by the sheet detecting sensor. Then, when the leading end of the sheet reaches the detecting position of the sheet detecting sensor, an elapsed time from the time when the leading end of the sheet reaches the detecting position is measured, and the controller 305 discriminates whether or not a time necessary for the leading end of the sheet to reach the fixing nip N has elapsed. When the elapsed time from the time when the leading end of the sheet reaches the detecting position exceeds the time necessary for the leading end of the sheet to reach the fixing nip, the controller 305 discriminates that the leading end of the sheet reaches the fixing nip N (S13: Y).

When the leading end of the sheet reaches the fixing nip N, the controller 305 switches the state of the second suction fan 206 from the ON state to the OF state (S14). Here, an operation mode of the sheet relative to the feeding surface 20A by the switching of the second suction fan 206 between the ON state and the OFF state will be described. In the case where an operation of the second suction fan 206 is in the OFF state, a suction force (attraction force) for sucking the air through the second feeding belt 201 by the second suction fan 206 is a suction force of a degree such that the sheet is freely movable relative to the feeding surface 20A of the second feeding belt 201. An example of the second suction force is the suction force of the degree such that the sheet is freely movable relative to the feeding surface 20A of the second feeding belt 201. On the other hand, in the case where the operation of the second suction fan 206 is in the ON state, the suction force for sucking the air through the second feeding belt 206 by the second suction fan 206 is a suction force of a degree such that the sheet is attracted to the feeding surface 20A of the second feeding belt 201. This is because the air suction force is increased by driving the second suction fan 206 and thus a phenomenon such that air stream generates from the outer peripheral surface toward the inner peripheral surface of the second feeding belt 201 and the sheet is attracted to the feeding surface 20A occurs. An example of the first suction force in this embodiment is the suction force for sucking the sheet to the feeding surface 20A of the second feeding belt 201, and the second suction force is smaller than the first suction force.

Further, the OFF state of the second suction fan 206 is not limited to a state in which the operation of the second suction fan 206 is at rest. That is, the second suction fan 206 is in the OFF state when the air suction force by the second suction fan 206 is smaller than the suction force of the degree such that the sheet is attracted to the feeding surface 20A and is the suction force of the degree such that the sheet is freely movable relative to the feeding surface 20A. By doing so, in a state in which the sheet is nipped in the secondary transfer nip N2 and the fixing nip N, it becomes possible to suppress attraction of the sheet to the feeding surface 20A. That is, a state in which the height of the sheet from the feeding surface 10A of the first feeding belt 101 is detectable without attracting the sheet to the feeding surface 20A. Incidentally, when the air suction force by the second suction fan 206 is made smaller than a sheet nipping force in the fixing nip N, the sheet nipped in the fixing nip N is prevented from being attracted to the feeding surface 20A. By doing so, the sheet nipped in the fixing nip N is not pulled toward an upstream side of the sheet feeding direction FD, and therefore, positional deviation of the (unfixed) toner on the sheet can be suppressed.

When the second suction fan 206 is put in the OFF state, the controller 305 discriminates the height of the sheet from the feeding surface 10A on the basis of the signal received from the height detecting means 30. Specifically, the controller 305 discriminates the sheet height from the feeding surface 10A depending on the combination of the signals of the sensors 302 and 303 received from the height detecting means 30. In the case where the signal of the sensor 302 is the OFF signal (S15: N), as described above, the OFF signal is also outputted from the sensor 303, and therefore, the controller 305 discriminates that the sheet is positioned above the feeding surface 10A than S1 is. Further, in this case, the sheet is in a stretched state between the fixing portion 58 and the secondary transfer portion 57 with respect to the sheet feeding direction FD and in a state in which the sheet is fed at a position remotest from the feeding surface 10A. In the case where the signal of the sensor 302 is the ON signal (S15: Y), the controller 305 decreases a drive amount of the fixing motor MF and establishes a speed relationship of VF<VT between the transfer speed VT and the fixing speed VF (S16). By this, it is possible to prevent the sheet from being excessively stretched toward the fixing portion 58. A second speed in this embodiment is the sheet feeding speed of the fixing portion 58 when being lower than the sheet feeding speed at the secondary transfer portion 57, i.e., the fixing speed VF when the speed relationship between the transfer speed VT and the fixing speed VF is VF<VT.

On the other hand, the signal from the sensor 302 is the ON signal (S15: N), the controller 305 discriminates whether or not the signal from the sensor 303 is the ON signal (S17). In the case where the signal of the sensor 302 is the ON signal and the signal of the sensor 303 is also the ON signal (S17: Y), the controller 305 discriminates that the sheet is positioned below the feeding surface 10A than S2 is. Further, in this case, the sheet is in an excessively loosened state between the fixing portion 58 and the secondary transfer portion 57 with respect to the sheet feeding direction FD and in a state in which the sheet is fed at a position closest to the feeding surface 10A (such as in a contact state with the feeding surface 10A). In the case where the signal of the sensor 302 is the ON signal and the signal of the sensor 303 is the ON signal (S17: Y), the controller 305 increases the drive amount of the fixing motor MF and establishes a speed relationship of VF>VT between the transfer speed VT and the fixing speed VF (S18). By this, the sheet is pulled toward the fixing portion 58, and therefore, looseness formed on the sheet is gradually eliminated, so that it is possible to prevent that a state in which a loop amount of the sheet becomes excessive is formed. A first speed in this embodiment is the sheet feeding speed at the secondary transfer portion 57, i.e., the transfer speed VT. Further, a third speed in this embodiment is the sheet feeding speed of the fixing portion 58 when being lower than the sheet feeding speed at the secondary transfer portion 57, i.e., the fixing speed VF when the speed relationship between the transfer speed VT and the fixing speed VF is VF>VT.

In the case where the signal of the sensor 302 is the ON signal and the signal of the sensor 303 is the OFF signal (S17: N), the controller 305 discriminates that the sheet is positioned between S1 and S2 relative to the feeding surface 10A. Further, in this case, with respect to the sheet feeding direction FD, between the fixing portion 58 and the secondary transfer portion 57, the sheet is in a spaced state from the feeding surface 10A and is in a loosened state. In the case where the signal of the sensor 302 is the ON signal and the signal of the sensor 303 is the OFF signal (S17: N), the controller 305 continues the feeding of the sheet without changing the fixing speed VF and the sequence goes to S19. Thus, in this embodiment, in a state in which the sheet is nipped in the secondary transfer nip N2 and in the fixing nip N and in which the height of the sheet from the feeding surface 10A is such that the sheet is spaced from the feeding surface 10A and is loosened, the feeding of the sheet is continued by maintaining the feeding speed VF.

As in the steps S16 and S18, in this embodiment, the fixing speed VF is adjusted depending on the signal outputted from the height detecting means 30, and therefore, during execution of the image forming job, the relationship of VF<VT changes in some instances. That is, in a state in which the sheet is nipped in the secondary transfer nip N2 and in the fixing nip N, the state of the sheet changes from a state in which the sheet is pulled toward a downstream side of the sheet feeding direction FD to a state in which the sheet is loosened in some instances. At this time, as in the step S14, the suction force for attracting the sheet to the feeding surface 20A is decreased, so that abrupt displacement of the sheet relative to the feeding surface 20A is suppressed.

The controller 305 discriminates whether or not a trailing end of the sheet passes through the secondary transfer nip N2 (S19), and repeats the steps from S15 to S18 until the trailing end of the sheet passes through the secondary transfer nip N2. Specifically, as regards discrimination as to whether or not the trailing end of the sheet passes through the secondary transfer nip N2, for example, first, the controller 305 awaits until the leading end of the sheet is detected by the sheet detecting sensor after the feeding of the sheet is started. Then, when the leading end of the sheet reaches the detecting position of the sheet detecting sensor, an elapsed time from the time when the leading end of the sheet reaches the detecting position is measured, and the controller 305 discriminates whether or not a time necessary for the trailing end of the sheet to pass through the secondary transfer nip N2 has elapsed. When the elapsed time from the time when the leading end of the sheet reaches the detecting position exceeds the time necessary for the trailing end of the sheet to pass through the secondary transfer nip N2, the controller 305 discriminates that the trailing end of the sheet passes through the secondary transfer nip N2 (S19: Y). When the controller 305 discriminates that the trailing end of the sheet passes through the secondary transfer nip N2 (S19: Y), the controller 305 ends the execution of the adjusting operation (S15 to S19) of the fixing speed VF adjusted depending on the signal outputted from the height detecting means 30 (S20).

Next, the controller 305 awaits until the trailing end of the sheet passes through the fixing nip N (S21). Specifically, as regards discrimination as to whether or not the trailing end of the sheet passes through the secondary transfer nip N2, for example, first, the controller 305 awaits until the leading end of the sheet is detected by the sheet detecting sensor. Then, when the leading end of the sheet reaches the detecting position of the sheet detecting sensor, an elapsed time from the time when the leading end of the sheet reaches the detecting position is measured, and the controller 305 discriminates whether or not a time necessary for the trailing end of the sheet to pass through the fixing nip N. When the elapsed time from the time when the leading end of the sheet passes through the detecting position exceeds the time necessary for the trailing end of the sheet to pass through the fixing nip N, the controller 305 discriminates that the trailing end of the sheet passes through the fixing nip N (S21: N).

When the controller 305 discriminates that the trailing end of the sheet passes through the fixing nip N (S21: Y), the controller 305 switches the state of the second suction fan 206 from the OFF state to the ON state (S22). By this, a leading end of a subsequent sheet is attracted to the feeding surface 20A, so that it is possible to improve feeding efficiency of the subsequent sheet. Then, when the image forming job is not ended (S23: N), the sequence returns to S12, and when the image forming job is ended (S23: Y), the flow is ended.

In this embodiment, when a sheet of which length with respect to the sheet feeding direction FD is longer than a length between the secondary transfer nip N2 and the fixing nip N with respect to the sheet feeding direction FD, so-called an elongated sheet is fed, excessive looseness and excessive stretch of the sheet can be superposed. Further, by suppressing the excessive looseness and the excessive stretch of the sheet, it becomes possible to suppress improper transfer at the secondary transfer portion 57, improper sheet feeding and the like, and therefore, it is possible to compatibly realizing an improvement in sheet feeding performance and an improvement in image quality.

Further, in this embodiment, a speed relationship between the transfer speed VT and the fixing speed VF is changed depending on the height of the sheet, from the feeding surface 10A, nipped in the secondary transfer nip N2 and the fixing nip N. Specifically, in a state in which the sheet is excessively stretched by the fixing nip N, the fixing speed VF is decreased, so that a degree of the excessive stretch of the sheet toward the fixing portion 58 is alleviated. Further, in a state in which the sheet is excessively loosened, the fixing speed VF is increases, so that a degree of the excessive looseness is alleviated. Further, when the height of the sheet from the feeding surface 10A is detected, the sheet is prevented from being attracted to the second feeding belt 201, so that it is possible to detect the height of the sheet from the feeding surface 10A with reliability.

Further, in this embodiment, in the case where the sheet is fed between the fixing portion 58 and the secondary transfer portion 57 in a state in which the sheet is spaced from the feeding surface 10A and is loosened, the feeding of the sheet is continued without changing the fixing speed VF. Accordingly, without making unnecessary change in fixing speed VF, the sheet can be stably fed between the fixing portion 58 and the secondary transfer portion 57 with no contact thereof with the feeding surface 10A. Further, the change in fixing speed VF may only be required to be made minimally, and therefore, a degree of deviation of alignment between the first driving roller 102 and the follower rollers 103, 104 and 105 due to a frequent change in fixing speed VF can be reduced. Further, also, as the second driving roller 202 and the follower rollers 203, 204 and 205, a degree of deviation of alignment therebetween can be reduced.

Incidentally, in this embodiment, the length between the secondary transfer nip N2 and the fixing nip N is designed so as to be 19 inches (483 mm) or more. Accordingly, in the case where a sheet with a size such that a length thereof with respect to the sheet feeding direction FD is 19 inches or less, the sheet is fed without being put in a state in which the sheet is nipped in both the secondary transfer nip N2 and the fixing nip N. Here, with respect to the sheet feeding direction FD, a length from the second suction fan 206 to the fixing nip N is set at a length of a degree such that a sheet with a length with respect to the sheet feeding direction FD is shorter than a predetermined length. Here, the sheet with the length shorter than the predetermined length is, for example, about 148 mm with respect to the sheet feeding direction FD, and refers to a sheet, of sheets usable in the image forming apparatus 100, shortest in length with respect to the sheet feeding direction FD.

Further, with respect to the sheet feeding direction FD, lengths of the first feeding belt 201 and the second feeding belt 201 are designed so as to be always equal to each other. Incidentally, in this embodiment, the first feeding belt 101 and the second feeding belt 201 have the same constitution, and commonality of component parts thereof is realized, but the lengths of the first feeding belt 101 and the second feeding belt 202 may also be different from each other. For example, the length of the first feeding belt 101 with respect to the sheet feeding direction FD is made 3/10 of the length between the secondary transfer nip N2 and the fixing nip N. At this time, the length of the second feeding belt 201 with respect to the sheet feeding direction FD may also be made ½ of the length between the secondary transfer nip N2 and the fixing nip N.

Other Embodiments

In the embodiment 1, an example in which the belt feeding unit 100E is constituted by including the first belt feeding portion 10 and the second belt feeding portion 20 was described, but three or more belt feeding portions may also be included in the belt feeding unit 100E. In this case, a sheet feeding speed in a downstream belt feeding portion with respect to the sheet feeding direction FD is made higher than a sheet feeding speed in an upstream belt feeding portion with respect to the sheet feeding direction FD. By doing so, it becomes possible to suppress buckling of the sheet due to a difference in sheet feeding speed between the belt feeding portions. Further, in this case, a constitution corresponding to the height detecting means 30 may desirably be disposed on a side somewhat downstream of the center of the belt feeding unit 100E with respect to the sheet feeding direction.

Further, the constitution of the embodiment 1 is also applicable to a printer of a direct transfer type in which toner is directly transferred from the photosensitive drum as the image bearing member onto the sheet by a primary transfer roller as a transfer means.

The controller 305 in the embodiment 1 includes the central processing unit (CPU) and the memory. The CPU reads and executes a program stored in the memory and carries out integrated control of the image forming apparatus in cooperation with various functional portions for achieving specific functions. The memory includes a non-volatile memory medium such as a read-only memory (ROM) and a volatile memory medium such as a random-access memory (RAM), and not only constitutes a storage area of programs and data but also constitutes an operational (working) area when the CPU executes the program. Further, the memory is an example of a non-transient memory medium in which a program for controlling the image forming apparatus 100 is stored. Incidentally, the various functions of the controller 305 may also be mounted, as an independent hardware such as ASIC, on a circuit of the controller, or may also be mounted, as a functional unit of a program executed by the CPU or another processing device, in the form of a software.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-087088 filed on May 19, 2020, which is hereby incorporated by reference herein in its entirety.

What is claimed is:

1. An image forming apparatus comprising:

transfer means including a transfer nip in which a sheet is nipped and fed, said transfer means being configured to transfer a toner image onto the sheet nipped in the transfer nip;

fixing means including a fixing nip in which the sheet is nipped and fed, said fixing means being configured to fix the toner image, on the sheet, transferred by said transfer means;

a first feeder including (a) a first belt portion comprising a first endless belt with air permeability, said first belt portion forming a first feeding surface on which the sheet is fed, (b) a first stretcher for rotatably stretching said first belt portion, and (c) a first air sucking portion capable of attracting the sheet to said first feeding surface by sucking air through said first belt portion, said first feeder being configured to feed the sheet from said transfer means toward said fixing means by rotating said first endless belt;

a second feeder including (a) a second belt portion comprising a second endless belt with air permeability, said second belt portion forming a second feeding surface on which the sheet is fed, (b) a second stretcher for rotatably stretching said second belt portion, and (c) a second air sucking portion capable of attracting the sheet to said second feeding surface by sucking air through said second belt portion, wherein said second feeder is provided downstream of said first feeder with respect to a sheet feeding direction and is configured to feed the sheet, fed by said first feeder, toward said fixing means by rotating said second endless belt, wherein said first feeding surface is disposed at a position lower than the transfer nip, wherein said second feeding surface is disposed at a position lower than the fixing nip, and wherein a downstream end of said first feeding surface is positioned above an upstream end of said second feeding surface;

a detector configured to output a signal depending on a distance between said first feeding surface and the sheet, wherein said detector is provided in said first feeder and is provided downstream of a center of said first feeding surface with respect to the sheet feeding direction; and a controller configured to control said fixing means, wherein said controller controls said fixing means based on the signal outputted by said detector in a state that the sheet is fed and nipped by both the transfer nip and the fixing nip.

2. The image forming apparatus according to claim 1, wherein said detector includes:

a flag member displaceable depending on the height of the sheet the distance between said first feeding surface and the sheet, fed through said first belt portion, and being displaceable between (a) a first position where the sheet is separated from said first feeding surface and is in a stretched state while being nipped in the transfer nip and in the fixing nip, (b) a second position where the sheet is separated from said first feeding surface and is in a loosened state while being nipped by the transfer nip and the fixing nip, and (c) a third position where the distance between said first feeding surface and the sheet is closer to said first feeding surface than the second position is; and a first sensor and a second sensor which are switchable between a light transmission state and a light-blocking state depending on the position of said flag member, wherein said detector outputs a first signal, a second signal, and a third signal when said flag member is in the first position, the second position, and the third position, respectively, wherein said controller is capable of controlling said transfer means and starts feeding of the sheet from said transfer means toward said fixing means in a state in which a feeding speed of the sheet by said transfer means is a first speed, wherein in a state in which the sheet is nipped in the transfer nip and in the fixing nip, (a) in a case that the first signal is outputted from said detector, said controller changes a feeding speed of the sheet by said fixing means to a second speed lower than the first speed, (b) in a case that the third signal is outputted from said detector, said controller changes the feeding speed of the sheet by said fixing means to a third speed higher than the first speed, and (c) in a case that the second signal is outputted from said detector, said controller continues the feeding of the sheet without changing the feeding speed of the sheet by said fixing means.

3. The image forming apparatus according to claim 1, wherein said controller is capable of controlling said second feeder, and wherein in a case that a leading end of the sheet reaches the fixing nip in a state in which the sheet is nipped in the transfer nip, said controller switches a suction force of air by said second air sucking portion from a first suction force for sucking the sheet to said second feeding surface to a second suction force smaller than the first suction force.

4. The image forming apparatus according to claim 3, wherein in a case that a trailing end of the sheet nipped in the transfer nip and in the fixing nip passes through the fixing nip in a state in which said controller switches the suction force of the air by said second air sucking portion to the second suction force, said controller switches the suction force of the air by said second air sucking portion from the second suction force to the first suction force.

5. The image forming apparatus according to claim 1, wherein said first belt portion includes a third endless belt which has air permeability and which is provided with a gap from said first endless belt with respect to the widthwise direction of the sheet perpendicular to the sheet feeding direction, and wherein the detecting position of said detector is between said first endless belt and said third endless belt in said first belt portion with respect to the widthwise direction of the sheet.

6. The image forming apparatus according to claim 1, wherein a center of said second air sucking portion with respect to the sheet feeding direction is positioned downstream of a center of said second belt portion with respect to the sheet feeding direction.

7. The image forming apparatus according to claim 1, wherein said controller acquires information on a size of the sheet fed from said transfer means toward said fixing means and adjusts a feeding speed of the sheet by said fixing means in a case that a length of the sheet with respect to the sheet feeding direction is longer than a length from said transfer nip to said fixing nip with respect to the sheet feeding direction.

8. The image forming apparatus according to claim 1, wherein said fixing means includes (a) a heating roller for heating the sheet and (b) an opposite roller for forming said fixing nip in contact with said heating roller, and wherein a phantom line extended from said second feeding surface toward a downstream side with respect to the sheet feeding direction crosses a nip line, which is a tangential line of said fixing nip contacting said heating roller and said opposite roller, on a side downstream of said fixing nip with respect to the sheet feeding direction.

9. The image forming apparatus according to claim 8, further comprising a guiding member which crosses the phantom line on a side downstream of said second belt portion as viewed in the widthwise direction of the sheet perpendicular to the sheet feeding direction and which has a guiding surface on which a leading end of the sheet fed on said second feeding surface is guided toward said fixing nip.

10. The image forming apparatus according to claim 1, wherein said first feeding surface is positioned higher than said second feeding surface as viewed in the widthwise direction of the sheet perpendicular to the sheet feeding direction.

11. The image forming apparatus according to claim 7, wherein a length between the transfer nip and the fixing nip is configured so as to be 19 inches or more.

* * * * *